US010788778B2

(12) United States Patent
Tadaki

(10) Patent No.: US 10,788,778 B2
(45) Date of Patent: Sep. 29, 2020

(54) IMAGE FORMING APPARATUS WITH CONTROL CIRCUITRY TO EXECUTE A REFRESH OPERATION ON LATENT IMAGE BEARER

(71) Applicant: Yui Tadaki, Kanagawa (JP)

(72) Inventor: Yui Tadaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/655,408

(22) Filed: Oct. 17, 2019

(65) Prior Publication Data

US 2020/0174413 A1 Jun. 4, 2020

(30) Foreign Application Priority Data

Nov. 29, 2018 (JP) ..... 2018-224087

(51) Int. Cl.

| | |
|---|---|
| ***G03G 15/00*** | (2006.01) |
| ***G03G 15/043*** | (2006.01) |
| ***G03G 15/02*** | (2006.01) |
| ***G03G 21/20*** | (2006.01) |
| ***G03G 15/06*** | (2006.01) |
| ***G03G 15/08*** | (2006.01) |

(52) U.S. Cl.

CPC ..... *G03G 15/5041* (2013.01); *G03G 15/025* (2013.01); *G03G 15/043* (2013.01); *G03G 15/065* (2013.01); *G03G 15/0812* (2013.01); *G03G 21/206* (2013.01); *G03G 2215/00037* (2013.01); *G03G 2221/1645* (2013.01)

(58) Field of Classification Search

CPC ..... G03G 15/5041; G03G 15/0266; G03G 15/043; G03G 15/065; G03G 21/206

USPC ..... 399/49, 50, 51, 55, 92

See application file for complete search history.

(56) References Cited

U.S. PATENT DOCUMENTS 10,353,331 B2 * 7/2019 Takagami et al. ..... G03G 15/0266

FOREIGN PATENT DOCUMENTS

| | | |
|---|---|---|
| JP | 5-323740 | 12/1993 |
| JP | 7-191580 | 7/1995 |
| JP | 2003-131531 | 5/2003 |
| JP | 2005-301201 | 10/2005 |
| JP | 2007-225847 | 9/2007 |
| JP | 2009-031485 | 2/2009 |

(Continued)

*Primary Examiner* — William J Royer

(74) *Attorney, Agent, or Firm* — Oblon, McClelland, Maier & Neustadt, L.L.P.

(57) ABSTRACT

An image foil ling apparatus includes a latent image bearer, a charger, an exposure device, a developing device, a toner adhesion amount detector, and control circuitry. The control circuitry controls the charger, the exposure device, and the developing device to form a detection toner pattern shorter than a circumferential length of the latent image bearer in a circumferential direction of the latent image bearer at an area of the latent image bearer including at least a part of an opposite portion of the latent image bearer opposite the charger when the latent image bearer stops rotation, controls the toner adhesion amount detector to detect a toner adhesion amount of the detection toner pattern, and executes a refreshing operation to recover the surface of the latent image bearer from a deteriorated state due to a discharge product based on a result of the detection toner pattern detected by the toner adhesion amount detector.

7 Claims, 13 Drawing Sheets

(56) References Cited

FOREIGN PATENT DOCUMENTS

| | | |
|---|---|---|
| JP | 2010-032758 | 2/2010 |
| JP | 2010-133997 | 6/2010 |
| JP | 2012-083588 | 4/2012 |
| JP | 2012-145851 | 8/2012 |
| JP | 2014-137551 | 7/2014 |

* cited by examiner

IMAGE FORMING APPARATUS WITH CONTROL CIRCUITRY TO EXECUTE A REFRESH OPERATION ON LATENT IMAGE BEARER

CROSS-REFERENCE TO RELATED APPLICATION

This patent application is based on and claims priority pursuant to 35 U.S.C. § 119 to Japanese Patent Application No. 2018-224087, filed on Nov. 29, 2018 in the Japan Patent Office, the entire disclosure of which is hereby incorporated by reference herein.

BACKGROUND

Technical Field

This disclosure relates to an image forming apparatus.

Background Art

There are image forming apparatuses including a latent image bearer, a charger that discharges to charge a surface of the latent image bearer, an exposure device that exposes the latent image bearer to form an electrostatic latent image, a developing device that develops the electrostatic latent image on the latent image bearer to form a toner image, and a transfer device that transfers the toner image onto a recording medium to finally form the toner image on the recording medium.

In the above-described image forming apparatus, the discharge of the charger generates discharge products such as NOx and SOx, and adhesion of the discharge products to the latent image bearer may cause image deterioration called image deletion.

SUMMARY

This specification describes an improved image forming apparatus that includes a latent image bearer, a charger configured to charge a surface of the latent image bearer, an exposure device configured to expose the surface of the latent image bearer to form an electrostatic latent image of a detection toner pattern on the latent image bearer, a developing device configured to develop the electrostatic latent image of the detection toner pattern on the surface of the latent image bearer to form the detection toner pattern, a toner adhesion amount detector configured to detect a toner adhesion amount of the detection toner pattern formed on the latent image bearer, and control circuitry. The control circuitry is configured to control the charger, the exposure device, and the developing device to form the detection toner pattern shorter than a circumferential length of the latent image bearer in a circumferential direction of the latent image bearer at an area of the latent image bearer including at least a part of an opposite portion of the latent image bearer opposite the charger when the latent image bearer stops rotation, control the toner adhesion amount detector to detect the toner adhesion amount of the detection toner pattern, and execute a refreshing operation to recover the surface of the latent image bearer from a deteriorated state due to a discharge product based on a result of the detection toner pattern detected by the toner adhesion amount detector.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
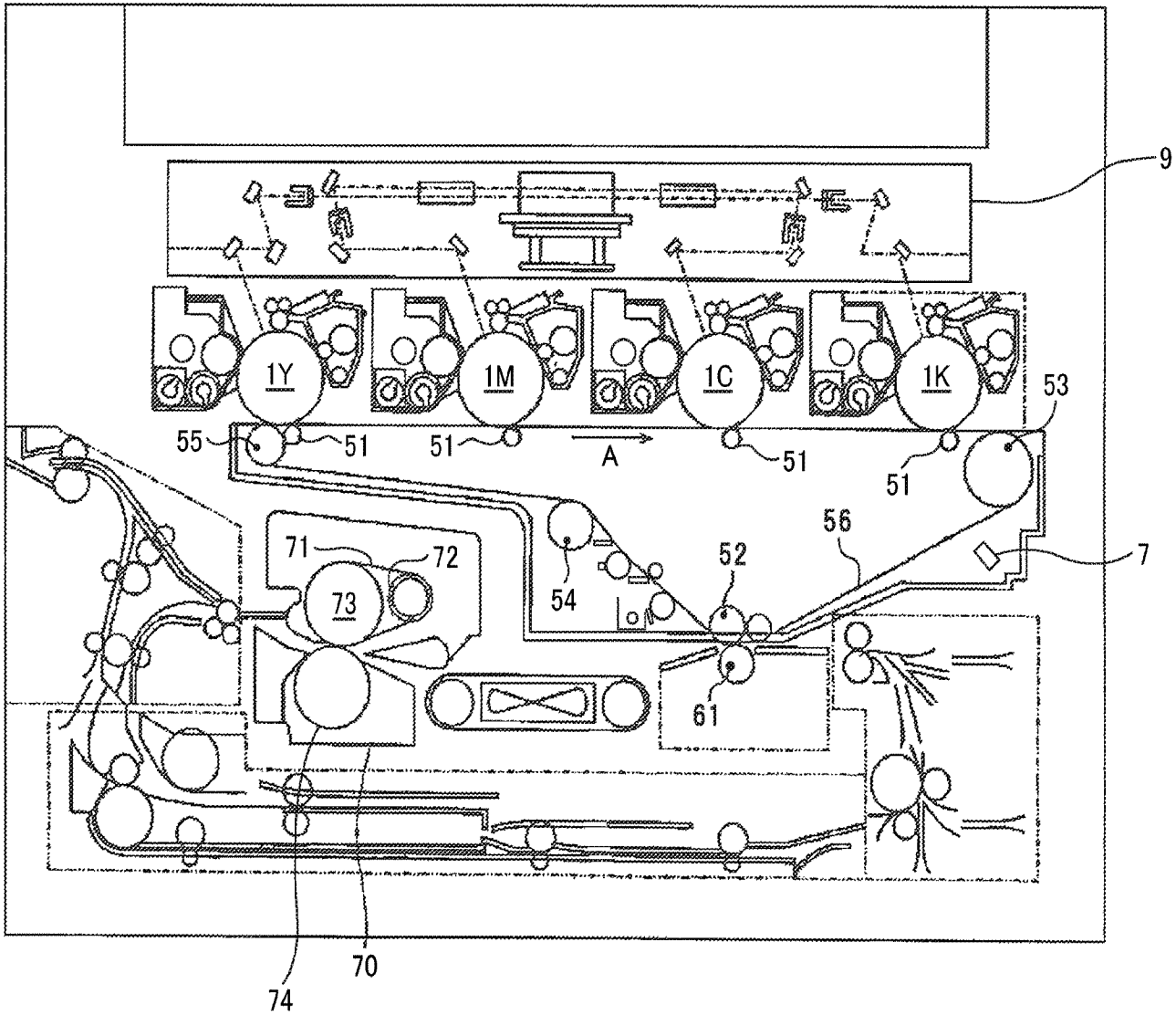
FIG. 1 is a diagram illustrating a schematic configuration of a printer according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

Now, a description is given of an electrophotographic printer as an image forming apparatus according to an embodiment of the present disclosure. It is to be noted that, hereinafter, the electrophotographic printer is referred to as "the printer". In the present embodiment, the description is given by an example of a tandem type image forming apparatus employing an intermediate transfer method and using four photoconductors as latent image bearers aligned in a direction of rotation of an intermediate transferor, but the present disclosure is not limited to this embodiment. The present disclosure may be applied to image forming apparatuses including the latent image bearer, a charger that discharges to charge a surface of the latent image bearer, an exposure device that exposes the latent image bearer to form an electrostatic latent image, a developing device that develops the electrostatic latent image on the latent image bearer to form a toner image, and a transfer device that transfers the toner image onto a recording medium to finally form the toner image on the recording medium. For example, the present disclosure may be applied to an image forming apparatus including only one latent image bearer and employing at least one of a direct transfer method and the intermediate transfer method.

FIG. 1 is a schematic diagram illustrating a configuration of the printer according to the present embodiment.

As illustrated in FIG. 1, the printer according to the present embodiment includes an intermediate transfer belt 56 as the intermediate transferor, which is an image bearer, in a substantially center of the printer. The intermediate transfer belt 56 is an endless belt made of a heat-resistant material such as polyimide or polyamide and including a base layer adjusted to have medium resistance. The intermediate transfer belt 56 is wound around and supported by four rollers 52, 53, 54, and 55 and is driven to rotate in a direction of arrow A. Above the intermediate transfer belt 56, four image forming units, including photoconductors 1Y, 1M, 1C and 1K, each corresponding to toner of specific color, that is, yellow (Y), magenta (M), cyan (C), and black (K), are disposed side by side along the direction of rotation of the intermediate transfer belt 56.

Figure 2:
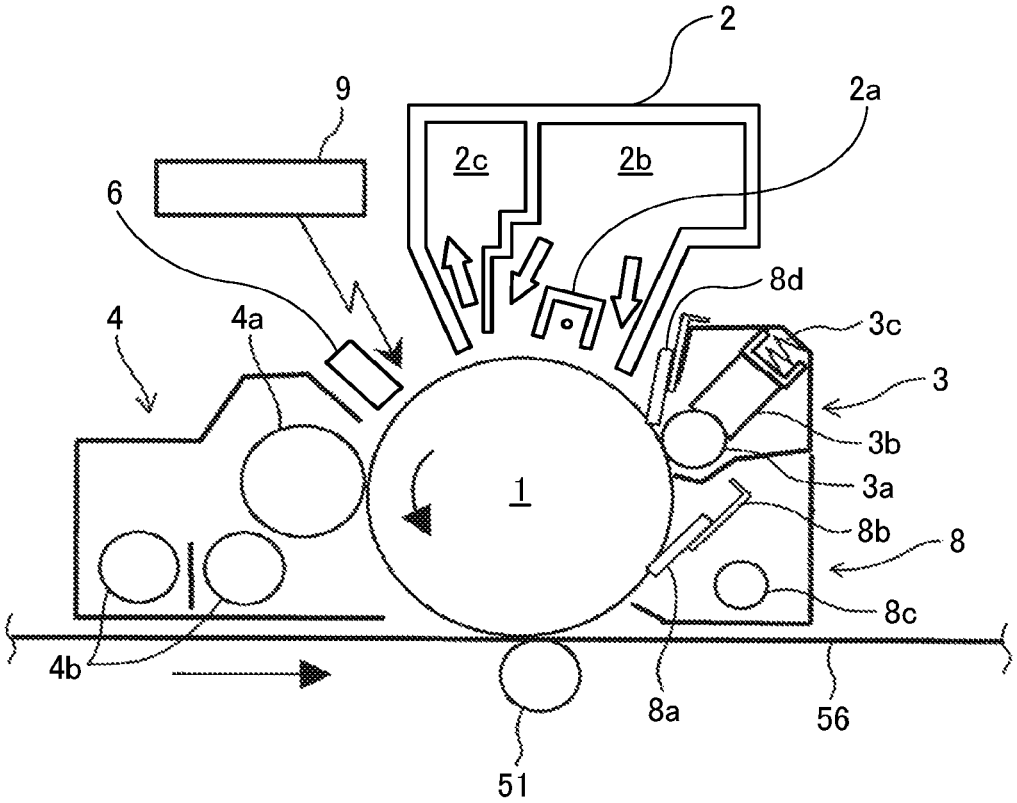
FIG. 2 is an enlarged view illustrating one of four image forming units in the printer in FIG. 1.

FIG. 2 is an enlarged view illustrating one of four image forming units in FIG. 1.

The image forming units have a similar configuration, and thus suffixes Y, M, C, and K, each indicating the color of toner used are hereinafter omitted. Each image forming unit includes a photoconductor 1 as the latent image bearer. Around the photoconductor 1, the image forming unit includes a charging device 2, a potential sensor 6 as a potential detector, a developing device 4, a cleaner 8, and a lubrication device 3.

The charging device 2 is a contactless type charger having a charger 2*a* that uniformly charges the surface of the photoconductor 1 to a desired negative potential, but other charging methods may be used as long as the charging methods use discharge. The potential sensor 6 is a sensor to detect a surface potential of the photoconductor 1. The developing device 4 develops an electrostatic latent image formed on the surface of the photoconductor 1 with toner of specified color charged to negative polarity to form a toner image. The lubrication device 3 applies lubricant to the surface of the photoconductor 1 to form a protection layer. The cleaner 8 collects toner remaining on the surface of the photoconductor 1 after the toner image is transferred to the intermediate transfer belt 56. The toner collected by the cleaner 8 passes through a conveyance passage in the cleaner 8 and is conveyed to a toner collection container installed in a body of the printer.

The image forming unit is configured as a process cartridge removably installable in the body of the printer so that the photoconductor 1, the charging device 2, the developing device 4, the cleaner 8, and the lubrication device 3 are replaceable at a time.

As illustrated in FIG. 1, an exposure device 9 is disposed above the four image forming units. The exposure device 9 irradiates the surface of each photoconductor 1 charged by the charging device 2 with light according to image data of a corresponding color image, thereby lowering the potential of the irradiated portion, to form the electrostatic latent image on the surface of the photoconductor 1. Additionally, each of primary transfer rollers 51 as primary transferors of the transfer device is disposed opposite a respective photoconductor 1 via the intermediate transfer belt 56 and primarily transfers the toner image formed on the photoconductor 1 onto the intermediate transfer belt 56. The primary transfer roller 51 is electrically connected to a primary transfer power source and supplied with a predetermined voltage.

A secondary transfer roller 61 as a secondary transferor of the transfer device is pressed against an outer surface of the intermediate transfer belt 56 at a portion supported by the roller 52. The secondary transfer roller 61 is electrically connected to a secondary transfer power source and supplied with a predetermined voltage. A contact portion between the secondary transfer roller 61 and the intermediate transfer belt 56 is a secondary transfer portion at which the toner image on the intermediate transfer belt 56 is transferred onto a sheet as a recording medium.

On the left side of the secondary transfer portion in FIG. 1, a fixing device 70 is disposed to fix the toner image on the sheet. The fixing device 70 includes an endless fixing belt 71 looped over a fixing roller 73, a heating roller 72 including a halogen heater in its interior, and a pressing roller 74 disposed opposite the fixing roller 73 via the fixing belt 71 and pressed against the fixing roller 73. A sheet feeder is disposed in a lower part of the printer to accommodate and feed the sheet to the secondary transfer portion.

Yellow, magenta, cyan and black toner images are sequentially transferred from the photoconductor 1 in each image fainting unit onto the intermediate transfer belt 56. The yellow, magenta, cyan, and black toner images formed on the photoconductors 1 are primarily transferred from the upstream photoconductor to the downstream photoconductor in a direction of rotation of the intermediate transfer belt 56 at different times so that the yellow, magenta, cyan, and black toner images are superimposed on a same position on the intermediate transfer belt 56. The toner image formed on the intermediate transfer belt 56 reaches the secondary transfer portion and is secondary transferred onto the sheet timed and conveyed from the sheet feeder. Similar to the cleaner 8 in the image forming unit, an intermediate transferor cleaner collects toner remaining on the intermediate transfer belt 56 after the secondary transfer, and the toner is conveyed to the toner collection container installed in the body of the printer. The sheet on which the toner image is secondarily transferred is conveyed to the fixing device 70, thermally fixed the toner image, and ejected by a sheet ejection roller.

The photoconductor 1 is an organic photoconductor having a protective layer made of polycarbonate resin, for example. As illustrated in FIG. 2, the developing device 4 includes a developing sleeve 4*a* as a developer bearer opposite the photoconductor 1. Inside the developing sleeve 4*a*, a magnetic field generator is provided. Beneath the developing sleeve 4*a*, two screws 4*b* are disposed to scoop up developer onto the developing sleeve 4*a* while mixing and agitating the developer with toner supplied from a toner bottle. The developing sleeve 4*a* scoops up the developer including toner and magnetic carriers, and a doctor blade forms a substantially uniform layer of the developer on the developing sleeve 4*a*. A developing bias is applied to the developing sleeve 4*a*. While rotating in a same direction as the direction of rotation of the photoconductor 1 at a position opposite the photoconductor 1, the developing sleeve 4*a* transports developer, and the developing bias works to supply toner from the developing sleeve 4*a* to the electrostatic latent image on the photoconductor 1. It is to be noted that although FIG. 2 illustrates the developing device 4 employing a two-component development, the embodiment is not limited thereto, but alternatively the developing device 4 may employ a single-component development.

The lubrication device 3 includes a solid lubricant 3*b* accommodated within a casing fixed in the image forming unit and, as a lubricant applicator, an application roller 3*a* that supplies powdered lubricant scraped off from the solid lubricant 3*b* onto the surface of the photoconductor 1. Examples of the application roller 3*a* include a brush roller, a urethane foam roller, and the like. The application roller 3*a* rotates in a direction counter to the direction of rotation of the photoconductor 1, that is, in the direction opposite the direction of rotation of the photoconductor 1 at the position where the application roller 3*a* contacts the photoconductor 1. The application roller 3*a* may rotate in the same direction as the photoconductor 1 at the position where the application roller 3*a* contacts the photoconductor 1.

The solid lubricant 3*b* is shaped rectangular parallelepiped and is pushed to the application roller 3*a* by a pressure spring 3*c*. As the lubricant of the solid lubricant 3*b*, a lubricant containing at least a fatty acid metal salt is used. As the fatty acid metal salt, for example, the following material may be used, that is, fatty acid metal salt having a lamellar crystal structure such as fluororesin, zinc stearate, calcium stearate, barium stearate, aluminum stearate, and magnesium stearate. Additionally, materials such as lauroyl lysine, monocetyl sodium phosphate, and lauroyltaurine calcium may be used.

Of these fatty acid metallic salts, zinc stearate is particularly preferable. This is because zinc stearate spreads well on the surface of the photoconductor 1 and has lower hygroscopicity. Further, zinc stearate maintains good lubrication even when humidity changes. Therefore, it is possible to form a coating layer of the lubricant having a high ability to protect the surface of the photoconductor 1 which is not easily affected by environmental changes, and the surface of the photoconductor can be well protected. Additionally, since the lubricating property thereof is not easily degraded, it is effective in inhibiting defective cleaning Note that, other than the fatty acid metal salts described above, liquid materials such as silicone oil, fluorine oil, and natural wax, or gaseous materials may be added externally.

The lubricant of the solid lubricant 3*b* preferably includes boron nitride that is inorganic lubricant. Examples of crystalline structures of boron nitride include, but are not limited to, a low-pressure phase hexagonal system (h-BN) and a high-pressure phase cubic system (c-BN). Of these, low-pressure phase hexagonal boron nitride crystal has a layered structure and is easily cleaved. This can maintain the friction coefficient at about 0.2 or less up to close to 400° C. The characteristics hardly change due to discharge, and the lubricity is not lost as compared with other lubricants even when subjected to the discharge. Adding such boron nitride prevents the lubricant supplied to the surface of the photoconductor 1 and thinned from deteriorating early due to the discharge generated when the charging device 2 or the primary transfer roller 51 is operated.

The characteristics of the boron nitride hardly change due to discharge, and the lubricity of the boron nitride is not lost as compared with other lubricants even when subjected to the discharge. In addition, the boron nitride can prevent a photoconductive layer of the photoconductor 1 from being oxidized and evaporated by the discharge. Additionally, even if the amount added is small, boron nitride exhibits a good lubricating property, and it is effective in preventing chatter of a cleaning blade 8*a* as well as problems caused by lubricant adhering to the charging device 2 or the like.

In the present embodiment, a lubricant material including zinc stearate and boron nitride is compressed into the solid lubricant 3*b*. The molding method of the solid lubricant 3*b* is not limited to this, and other molding methods such as melt molding may be employed. Thus, the effects of both zinc stearate and boron nitride can be attained.

The application roller 3*a* scrapes and consumes the solid lubricant 3*b*, and the thickness of the solid lubricant 3*b* decreases with time, but the solid lubricant 3*b* always contacts the application roller 3*a* because the pressure spring 3*c* presses the solid lubricant 3*b* against the application roller 3*a*. The application roller 3*a* applies lubricant scraped off from the solid lubricant 3*b* by rotations of the application roller 3*a* to the surface of the photoconductor 1. A leveling blade 8*d* disposed downstream from the application roller 3*a* spreads the applied lubricant to form a thin lubricant layer. The lubricant layer reduces the friction coefficient on the surface of the photoconductor 1. The very thin layer of lubricant adhering to the surface of the photoconductor 1 does not hinder the charging device 2 charging the photoconductor 1.

The cleaner 8 includes the cleaning blade 8*a* as a cleaning member, a support member 8*b*, and a toner collecting coil 8*c*. The cleaning blade 8*a* is made of a rubber such as urethane rubber or silicone rubber and formed in a plate shape, and the edge of the cleaning blade 8*a* contacts the surface of the photoconductor 1 to remove the toner remaining on the photoconductor 1 after transfer. The cleaning blade 8*a* is attached to and supported by the support member 8*b* made of metal, plastic, ceramic, or the like and is set at a predetermined angle with respect to the surface of the photoconductor 1. It is to be noted that the cleaner 8 is not limited to a cleaning blade but may be a known configuration such as a cleaning brush.

In the present embodiment, the lubrication device 3 is disposed downstream from the cleaner 8. The lubrication device 3 applies the lubricant to the surface of the photoconductor 1, and, subsequently, the leveling blade 8*d* slides on the surface of the photoconductor 1 to spread out the lubricant and roughly level unevenness of the lubricant applied to the surface of the photoconductor 1.

Figure 3:
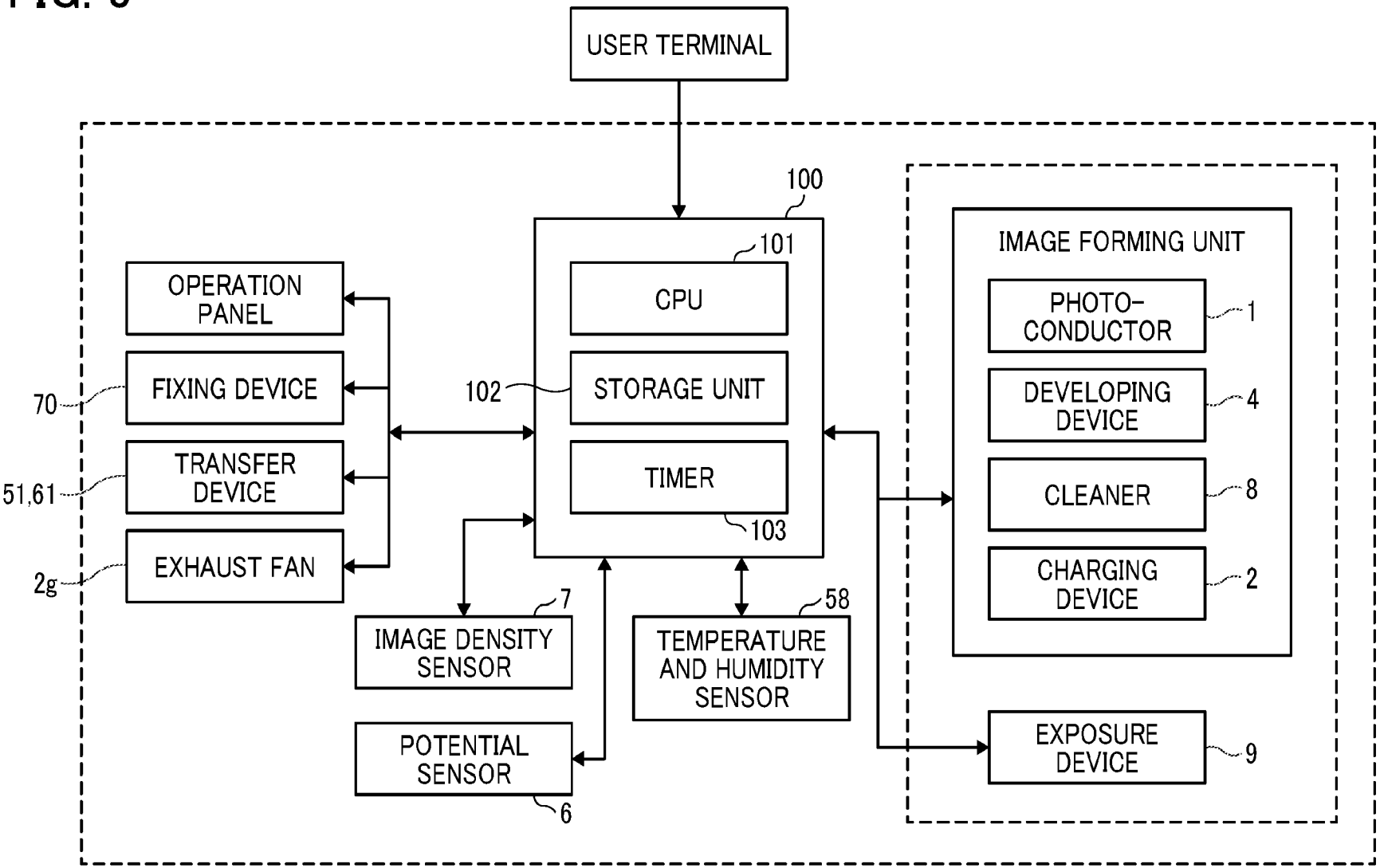
FIG. 3 is a block diagram illustrating a configuration of a control system in the printer in FIG. 1.

FIG. 3 is a block diagram illustrating a configuration of a control system in the printer according to the present embodiment.

As illustrated in FIG. 3, the control system includes a controller 100 to control operations of units in the printer of the present embodiment. The controller 100 is coupled to various units such as an image forming unit and the fixing device 70 in the printer and controls various operations such as rotation driving of the photoconductor 1, charging processing, and development processing.

The controller 100 includes a central processing unit (CPU) 101, a storage unit 102, a timer 103, and the like. The CPU 101 sends a control signal to each part of the printer, receives a signal from each part of the printer such as a temperature and humidity sensor 58, and performs various arithmetic processes based on control programs and data.

The storage unit 102 is configured by combining volatile and nonvolatile memories such as a read only memory (ROM), a random-access memory (RAM), a hard disk drive (HDD), and a flash ROM. The storage unit 102 stores various data such as a control program, control data, image data, and setting data.

The timer 103 calculates various timings required for printer control such as sheet conveyance timing. Additionally, the timer 103 measures an elapsed time after an image forming operation that is a print job completes and the photoconductor 1 stops rotations, that is, rotation stop time of the photoconductor 1.

Next, a refreshing operation is described that is a recovery action to recover the surface of the photoconductor 1 degraded by discharge products generated by the charging device 2.

Figure 4:
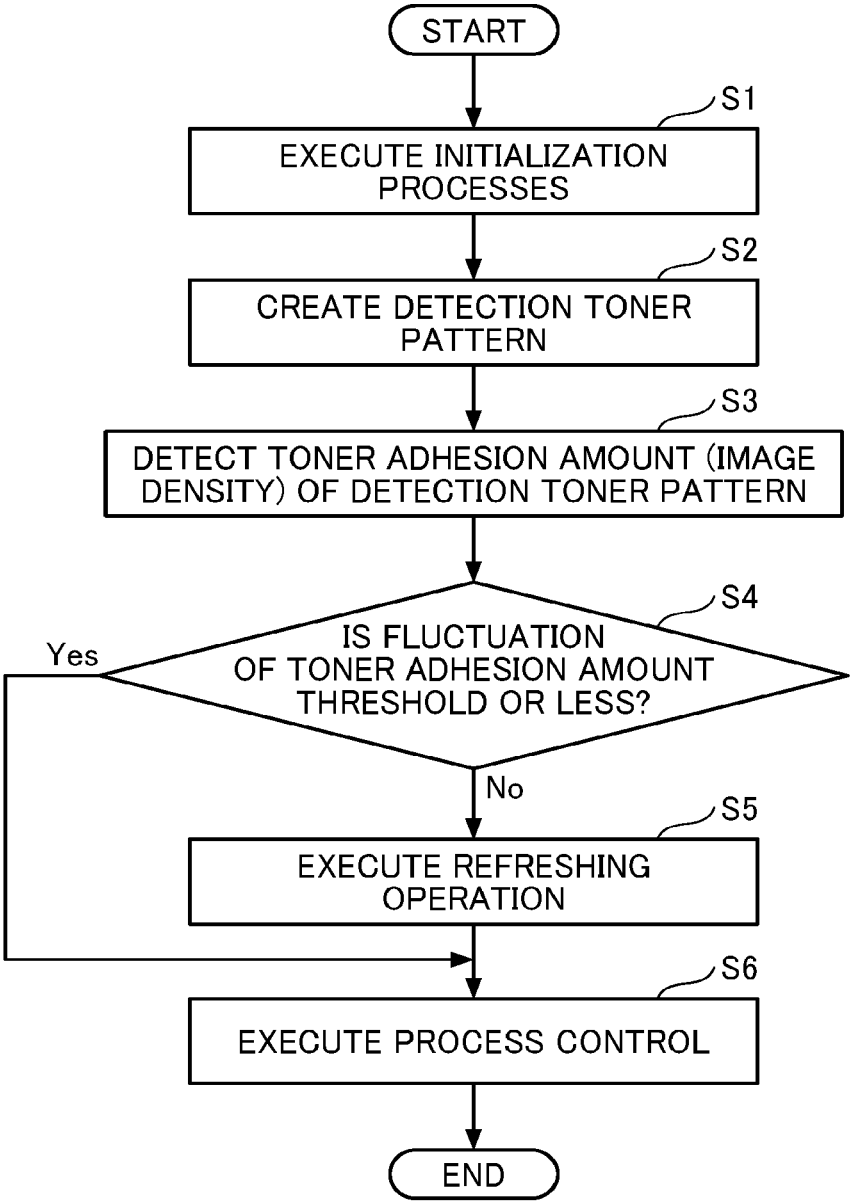
FIG. 4 is a flowchart of a refreshing operation according to the embodiment.

FIG. 4 is a flowchart of the refreshing operation according to the present embodiment.

In the present embodiment, at a predetermined time, for example, when the rotation stop time of the photoconductor 1 has reached a predetermined time and when the power of the printer is turned on or when the printer recovers from a power-saving mode, that is, a sleep mode, the controller 100 controls the image forming unit to form a detection toner pattern T and determines whether the refreshing operation is required. Specifically, when the predetermined operation timing arrives, the controller 100 determines whether the refreshing operation is required after various initialization processes and before image quality control that is called a process control.

In the present embodiment, when completing various initialization processes in step S1, the CPU 101 in the controller 100 executes a control program of the refreshing operation to create the detection toner pattern T in step S2. The detection toner pattern T is created by a typical image forming operation. That is, the charging device 2 uniformly charges the surface of the photoconductor 1, the exposure device 9 forms the electrostatic latent image corresponding to the detection toner pattern T on the charged surface of the photoconductor 1, and the developing device 4 develops the electrostatic latent image to create the detection toner pattern T. An image density sensor 7 that is also a toner adhesion amount detector detects a toner adhesion amount of the detection toner pattern T created as described above.

In the present embodiment, after the detection toner pattern T is formed on the surface of the photoconductor 1 and primarily transferred to the intermediate transfer belt 56, the image density sensor 7 detects an image density of the detection toner pattern T on the intermediate transfer belt 56 that results in the toner adhesion amount of the detection toner pattern T. However, detection of the image density sensor 7 is not limited to this. For example, the image density sensor 7 may detect the image density of the detection toner pattern T on the photoconductor 1 that results in the toner adhesion amount of the detection toner pattern T.

Figure 5:
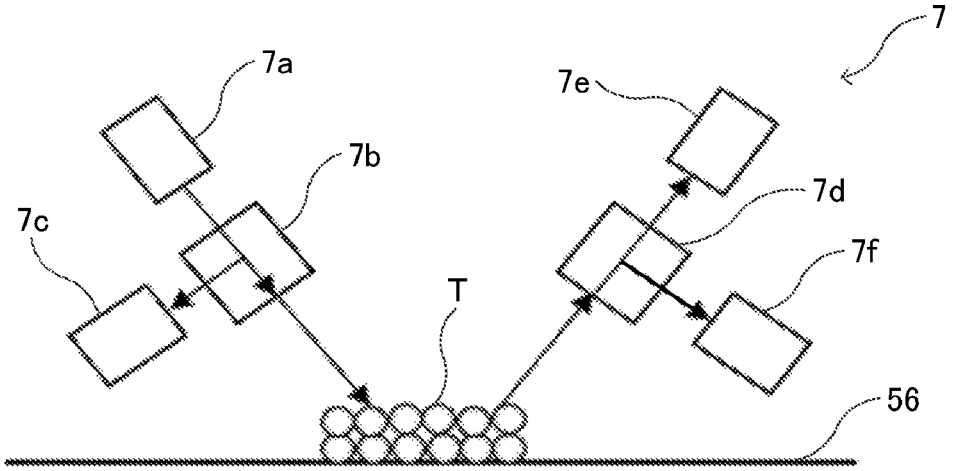
FIG. 5 is a schematic diagram illustrating an example of a configuration of an image density sensor in the printer in FIG. 1.

FIG. 5 is a schematic diagram illustrating an example of a configuration of the image density sensor 7.

The image density sensor 7 in the present embodiment is a reflective optical sensor. A light emitting unit 7*a* made of a light emitting diode (LED) or the like emits light, and a beam splitter 7*b* splits the light in two. The light reflected by the beam splitter 7*b* is received by a light receiving unit 7*c* made of a photodiode or the like to detect the light emission amount, and the light transmitted through the beam splitter 7*b* is irradiated toward the surface of the intermediate transfer belt 56.

When the detection toner pattern T formed on the intermediate transfer belt 56 passes through a detection area of the image density sensor 7, the light emitted from the light emitting unit 7*a* enters the detection toner pattern T and is reflected by the detection toner pattern T. A beam splitter 7*d* is positioned to receive the light specularly reflected by the detection toner pattern T. Light transmitted through the beam splitter 7*d* is received as the specularly reflected light by a specularly reflected light receiving unit 7*e*. On the other hand, the light diffusely reflected by the detection toner pattern T also enters the beam splitter 7*d* and is reflected by the beam splitter 7*d*, and a diffusely reflected light receiving unit 7*f* receives the diffusely reflected light.

The image density sensor sends the controller 100 output data that is received light amount data indicating received light amounts detected by the light receiving unit 7*c* to detect the light emission amount, the specularly reflected light receiving unit 7*e*, and the diffusely reflected light receiving unit 7*f*. The controller 100 executes an initialization process of the light emitting unit 7*a* to adjust the light emission amount to a target light emission amount based on the received light amount data detected by the light receiving unit 7*c* in step S1. Additionally, the controller 100 detects the toner adhesion amount of the detection toner pattern T based on the received light amount data of the detection toner pattern T from the specularly reflected light receiving unit 7*e* and the diffusely reflected light receiving unit 7*f* in step S3. For example, the controller 100 calculates the toner adhesion amount of the detection toner pattern T from the ratio between the received light amount from the specularly reflected light receiving unit 7*e* and the received light amount from the diffusely reflected light receiving unit 7*f*. Subsequently, the controller 100 determines whether a fluctuation range of the toner adhesion amount in the detection toner pattern T calculated based on the data from the image density sensor 7 is equal to or less than a threshold in step S4.

Since the detection toner pattern T is created to have a uniform toner adhesion amount, without image deletion on the surface of the photoconductor 1, the image density sensor 7 detects substantially the same toner adhesion amount in the detection toner pattern formed in any position in a circumferential direction of the photoconductor 1 that is a sub-scanning direction. Therefore, when the fluctuation range of the toner adhesion amount in the detection toner pattern T is equal to or less than the threshold (Yes in step S4), the controller 100 determines that the image deletion does not occur on the photoconductor 1.

On the other hand, when the image deletion occurs on a localized portion of the surface of the photoconductor 1 in the circumferential direction of the photoconductor 1, the detection toner pattern T includes a pattern portion corresponding to the portion on which the image deletion occurs and a pattern portion corresponding to a portion on which the image deletion does not occur. As a result of a decrease in electrical resistance of the photoconductor 1 at the portion on which the image deletion occurs, the toner adhesion amount of the pattern portion corresponding to the portion on which the image deletion occurs differs from that of the other pattern portion, that is, the pattern portion corresponding to the portion on which the image deletion does not occur. Since this causes the fluctuation range of the toner adhesion amount in the detection toner pattern T to exceed the threshold, that is, since the fluctuation range of the toner adhesion amount in the detection toner pattern T is not equal to or less than the threshold (No in step S4), the controller 100 determines that the image deletion occurs on the photoconductor 1.

Although the controller 100 calculates the received light amount data from the image density sensor 7 and uses the calculation results to determine whether the image deletion occurs in the present embodiment, alternatively the controller 100 may directly use output signals output from the image density sensor 7 that are analog voltage signals to determine whether the image deletion occurs simply. For example, the controller 100 can determine whether the image deletion occurs simply by acquiring voltage values obtained by analog-digital conversion of the output signals that are the analog voltage signals output from the image density sensor 7 and determining whether the difference between the maximum value and the minimum value of the acquired voltage values in the detection toner pattern T is equal to or less than a threshold (for example, 0.05 V) to determine whether the image deletion occurs.

The present inventor has found that image deletion is greatest at the surface portion of the photoconductor 1 opposite the charging device 2 when the photoconductor 1 stops rotation before printing (hereinafter referred to as a surface portion opposite the charger). Conceivably, this is because the charging device 2 generates the discharge products that causes the image deletion, most of the discharge products adhere to the surface portion of the photoconductor 1 opposite the charging device 2 while the photoconductor 1 stops rotation, and, as a result, the image deletion is more likely to occur at the surface portion opposite the charger 2*a* than the other surface portion.

Therefore, only forming the detection toner pattern T at the surface portion of the photoconductor 1 opposite the charger 2*a* when the photoconductor 1 stops rotating enables the controller 100 to detect whether the image deletion occurs at the surface portion of the photoconductor 1 at which the image deletion initially occurs in the circumferential direction of the photoconductor 1 based on the toner adhesion amount of the detection toner pattern T. In the present embodiment, the detection toner pattern T is formed at an area in the circumferential direction of the photoconductor 1, the area including at least a part of the surface portion of the photoconductor 1 opposite the charger 2*a* when the photoconductor 1 stops rotating.

In the present embodiment, a length of the detection toner pattern T in the circumferential direction of the photoconductor 1 is shorter than a circumferential length of the photoconductor 1 to avoid decrease of toner yield caused by forming the detection toner pattern T. The shorter the length of the detection toner pattern T in the circumferential direction of the photoconductor 1 is, the greater the toner yield is. Therefore, in the circumferential direction of the photoconductor 1, the length of the detection toner pattern T may be shorter than the length of the surface portion of the photoconductor 1 opposite the charger 2*a* when the photoconductor 1 stops rotating that is the length of surface portion charged by the charging device 2. Even in this case, if an appropriate threshold is set so that the controller 100 can distinguish the toner adhesion amount detection result of the detection toner pattern T at the surface portion at which the image deletion occurs from other results, the controller 100 can determine whether the image deletion occurs based on the comparison between the threshold and the toner adhesion amount detection result of the detection toner pattern T.

However, the toner adhesion amount detection result of the detection toner pattern T is affected by not only the image deletion but also changes in image forming conditions, environmental changes, and the like. Therefore, it may be difficult to set the threshold as described above.

In the circumferential direction of the photoconductor 1, the detection toner pattern T in the present embodiment includes the area including at least a part of the surface portion of the photoconductor 1 opposite the charger 2*a* when the photoconductor stops the rotation and an area including at least a part of a surface portion other than the surface portion of the photoconductor 1 opposite the charger 2*a* when the photoconductor stops the rotation (hereinafter referred to as a surface portion not opposite the charger 2*a*).

Creating such the detection toner pattern T enables the controller 100 to determine whether the image deletion occurs based on the comparison of the detection result (toner adhesion amount), detected by the image density sensor 7, of the detection toner pattern T corresponding to the surface portion of the photoconductor 1 opposite the charger 2*a* when the photoconductor 1 stops the rotation and the detection result (toner adhesion amount), detected by the image density sensor 7, of the detection toner pattern T corresponding to the surface portion not opposite the charger 2*a*. That is, when the image deletion occurs, the controller 100 can check the relative difference in the toner adhesion amount between the surface portion not opposite the charger 2*a* at which the image deletion does not occur and the surface portion opposite the charger 2*a* at which the image deletion does occur. Therefore, the controller 100 can remove the influence of changes in image forming conditions and environmental fluctuations and determine whether the image deletion occurs more accurately.

Figure 6:
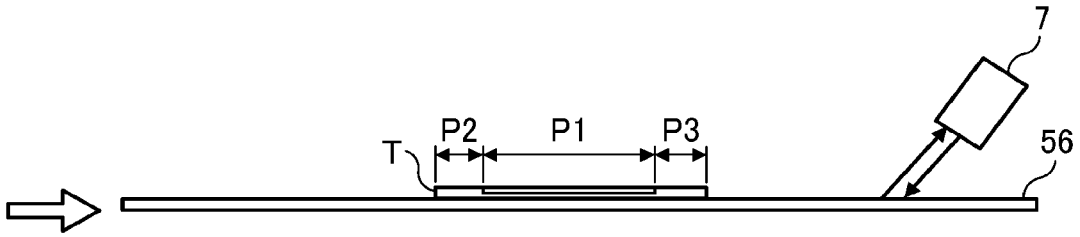
FIG. 6 is an explanatory diagram illustrating an example of a detection toner pattern T used in the refreshing operation.

FIG. 6 is an explanatory diagram illustrating an example of the detection toner pattern T used in the present embodiment.

The detection toner pattern T used in the present embodiment is preferably up to about ¼ of the circumferential length of the cylindrical photoconductor 1 having a radius of 100 mm that is 157 mm at the longest. A width of the detection toner pattern T that is a length in an axial direction of the photoconductor 1 is determined based on a detection area of the image density sensor 7 and is 12 mm in the present embodiment.

Preferably, the detection toner pattern T used in the present embodiment includes a surface portion P1 of the photoconductor 1 opposite an entire opening of the charger 2*a* when the photoconductor 1 stops rotating and the surface portions P2 and P3 not opposite the charger 2*a* adjacent to the surface portion P1 from both sides in the circumferential direction of the photoconductor 1. Since the length of the surface portion P1 in the circumferential direction is about 43 mm, the length of the detection toner pattern T used in the present embodiment is set to 80 mm, and, as illustrated in FIG. 6, the detection toner pattern T is formed to include the surface portion P1 and the surface portions P2 and P3.

Additionally, one of the image forming conditions of the detection toner pattern T is an image pattern such as 4 by 4 uniformly set in the detection toner pattern T that gives a large contrast between the portion at which the image deletion occurs and the portion at which the image deletion does not occur. Specifically, for example, the exposure intensity of the exposure device 9 that is a writing LD power is set to 100%, the developing bias is set to −450 V, and the image density of the detection toner pattern is set to 20%, that is, a halftone.

Figure 7:
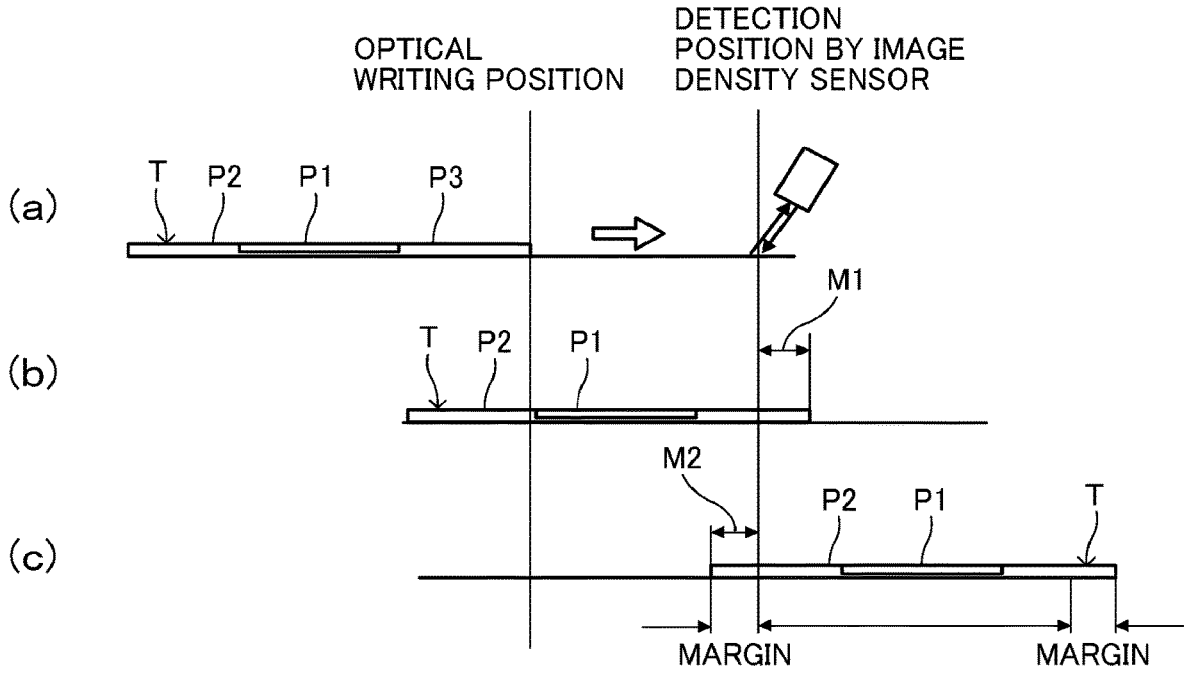
FIG. 7 is an explanatory diagram illustrating a relation among a position of the detection toner pattern T on a toner image conveyance path, an optical writing position by an exposure device, and a detection position by the image density sensor.

FIG. 7 is an explanatory diagram illustrating a relation among a position of the detection toner pattern T on a toner image conveyance path, an optical writing position by an exposure device 9, and a detection position by the image density sensor 7. FIG. 7 (*a*) illustrates the relation among the above-described three positions when the exposure device 9 starts to write the electrostatic latent image corresponding to the detection toner pattern T. FIG. 7 (*b*) illustrates the relation among the above-described three positions when the image density sensor 7 starts to detect the detection toner pattern T. FIG. 7 (*c*) illustrates the relation among the above-described three positions when the image density sensor 7 completes the detection of the detection toner pattern T.

In the example illustrated in FIG. 7, the length of the detection toner pattern T is set to 157 mm that is about ¼ of the circumferential length of the photoconductor 1. The image density sensor 7 outputs 53 points of the output signals at a sampling interval of 4 msec.

When the length of the detection toner pattern T is set to 157 mm that is about ¼ of the circumferential length of the photoconductor 1, for example, a detection start timing of the image density sensor 7 is set to 436 msec after the photoconductor 1 starts the rotation, and a detection end timing of the image density sensor 7 is set to 644 msec after the photoconductor 1 starts the rotation. Therefore, the period during which the image density sensor 7 performs detection is 208 msec. In this case, the image density sensor 7 detects the detection toner pattern T at a detection distance of 137 mm that is shorter than the total length (157 mm) of the detection toner pattern T. Setting margins M1, M2 of about 10 min at the front and rear ends of the detection toner pattern T, respectively, enables the image density sensor 7 to detect an area of the detection toner pattern T corresponding to all of the surface portion P1 opposite the charger 2*a* and the surface portions P2 and P3 not opposite the charger 2*a* even if the detection tuning of the image density sensor 7 is shifted.

When the controller 100 determines that the fluctuation range of the toner adhesion amount in the detection toner pattern T exceeds the threshold (No in step S4), the controller 100 determines that the image deletion occurs and executes the refreshing operation in step S5 and the process control in step S6. As long as the refreshing operation can recover the surface of the photoconductor 1 from a deteriorated state caused by the discharge product, the content of the refreshing operation is not particularly limited. For example, the refreshing operation may be the following operation: That is, the developing device 4 may form a toner band image on the surface of the photoconductor 1 extending in the axial direction of the photoconductor 1. Polishing action of the toner scrapes the surface of the photoconductor 1 and removes causative substances of the image deletion adhering to the surface of the photoconductor 1.

On the other hand, when the controller 100 determines that the fluctuation range of the toner adhesion amount in the detection toner pattern T is equal to or less than the threshold (Yes in step S4), the controller 100 determines that the image deletion does not occur and executes the process control in step S6 without executing the refreshing operation.

As described above, according to the present embodiment, since, in the circumferential direction of the photoconductor 1, the image deletion initially occurs at the surface portion of the photoconductor 1 opposite the charger when the photoconductor 1 stops rotating, forming the detection toner pattern T shorter than the circumferential length of the photoconductor 1 at the area including the surface portion opposite the charger 2*a* avoids the decrease of the toner yield and allows the detection of the image deletion occurrence with the same accuracy as a detection of the image deletion occurrence using a detection toner pattern longer than or equal to the circumferential length of the photoconductor 1.

In order to obtain this effect, preferably, the portion at which the image deletion occurs in the circumferential direction of the photoconductor 1 is localized at the surface portion opposite the charger 2*a*. This is because the detection of the image deletion that occurs at a portion longer than the surface portion opposite the charger 2*a* in the circumferential direction of the photoconductor 1 needs a longer detection toner pattern, which reduces the advantage of avoiding the decrease of the toner yield.

Effective countermeasures to localize the portion at which the image deletion occurs in the circumferential direction of the photoconductor 1 to the surface portion opposite the charger 2*a* include optimization of a lubricant application amount and an airflow around the photoconductor 1 generated by an exhaust mechanism to exhaust the surrounding gas of the photoconductor 1.

Figure 8:
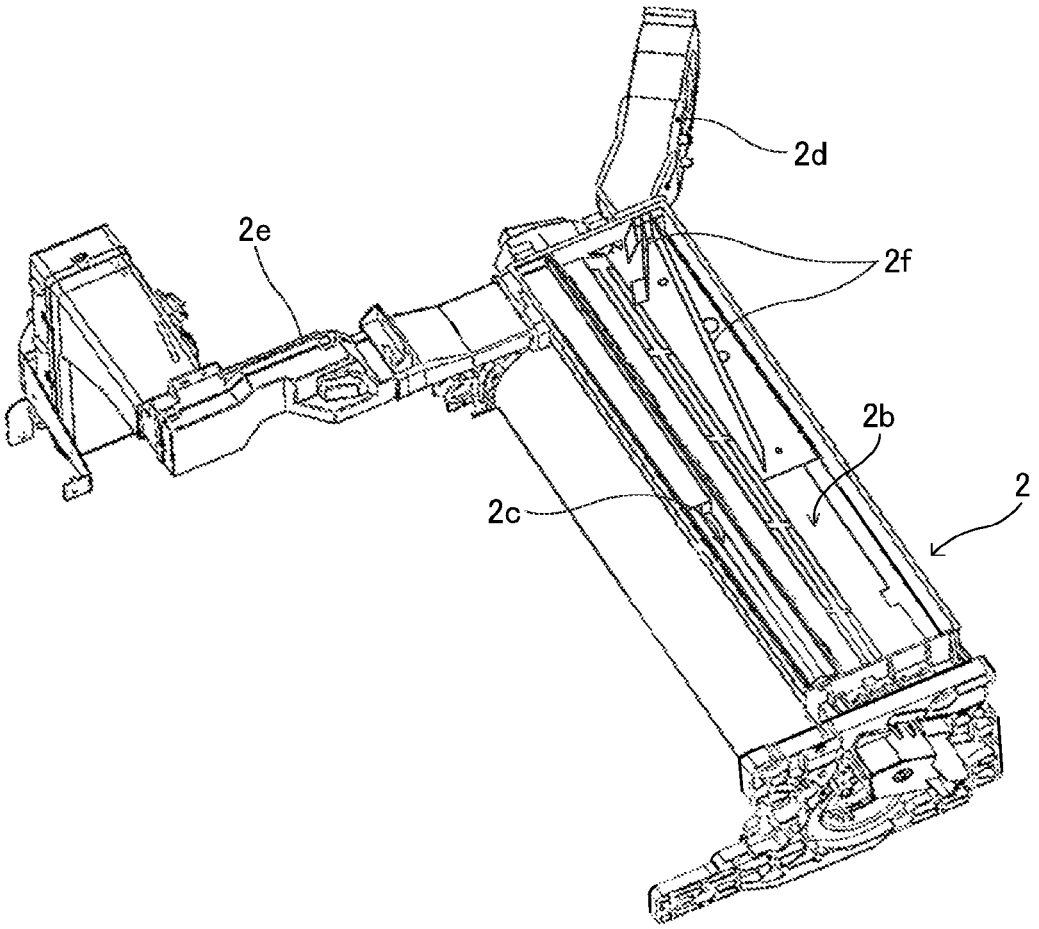
FIG. 8 is a perspective view illustrating an exhaust mechanism for a charger before improvement.
Figure 9:
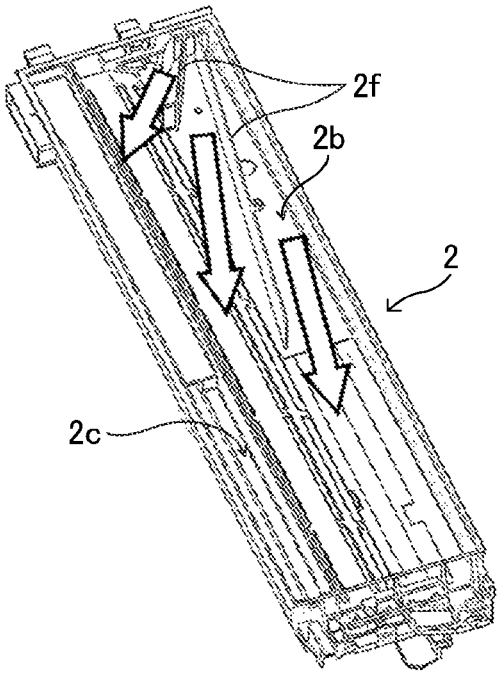
FIG. 9 is an explanatory diagram illustrating an airflow in the exhaust mechanism in FIG. 8.

FIG. 8 is a perspective view illustrating an exhaust mechanism for the charging device 2 before improvement. FIG. 9 is an explanatory diagram illustrating an airflow in the exhaust mechanism in FIG. 8. In FIG. 8, a ceiling of the charging device 2 is removed to illustrate a configuration of the exhaust mechanism.

The exhaust mechanism provided in the charging device 2 before improvement sends airflow from an intake duct 2*d* to a first flow path 2*b* provided across the photoconductor 1 in the axial direction of the photoconductor 1 in an upper portion of the charging device 2. The first flow path 2*b* includes a partition plate 2*f* to guide the airflow sent from the intake duct 2*d* and divide into three, the closest side, the second closest side, and the far side from the intake duct 2*d* in the axial direction of the photoconductor 1. As illustrated in FIG. 2, an outlet of the first flow path 2*b* communicates with the surface of the photoconductor 1 through the periphery of the charger 2*a*. Thus, the airflow from the intake duct 2*d* is exhausted toward the surface of the photoconductor 1 through the first flow path 2*b*.

On the other hand, as illustrated in FIG. 2, an inlet of a second flow path 2*c* communicating with an exhaust duct 2*e* is disposed downstream from the outlet of the first flow path 2*b* in the direction of rotation of the photoconductor 1. The rotation of the photoconductor 1 causes an airflow flowing along the surface of the photoconductor 1 toward the downstream side in the direction of rotation of the photoconductor 1 that guides the airflow exhausted from the intake duct 2*d* through the first flow path 2*b* toward the surface of the photoconductor 1 to the inlet of the second flow path 2*c* to enter the inlet of the second flow path 2*c* and be exhausted to the exhaust duct 2*e*. The airflow described above carries the discharge products generated by the discharge in the charger 2*a* to the exhaust duct 2*e*.

However, in the exhaust mechanism before improvement, the airflow does not smoothly flow in the vicinity of the end portion of the first flow path 2*b* far from the intake duct 2*d*. This may cause accumulation of the discharge products on the photoconductor 1 near the end portion. As a result, the image deletion is likely to occur on an end portion of the photoconductor surface in the axial direction of the photoconductor 1. To detect the image deletion, it is preferable to create the detection toner pattern T on the end portion of the photoconductor surface in the axial direction of the photoconductor 1. However, in the end portion, the portion at which the image deletion occurs spreads out of the surface portion opposite the charger 2*a* in the circumferential direction of the photoconductor 1. The short detection toner pattern sometimes causes difficulty in the accurate detection of the occurrence of the image deletion.

Figure 10:
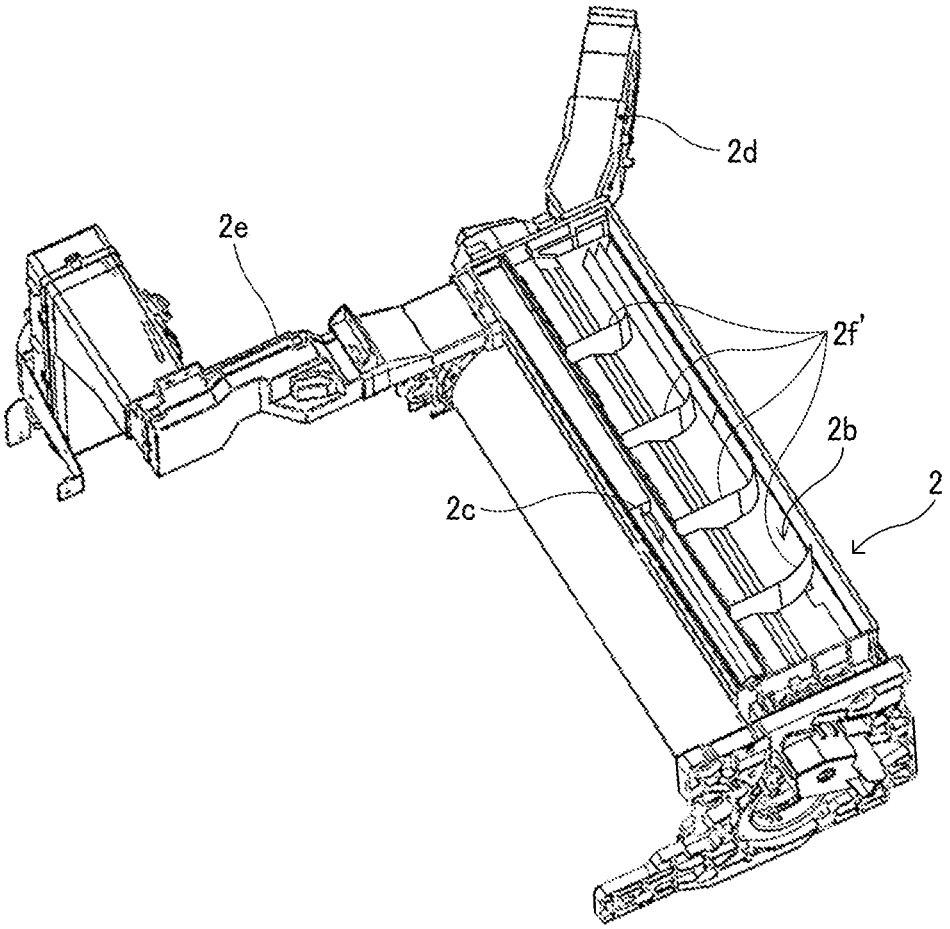
FIG. 10 is a perspective view illustrating an exhaust mechanism for the charger after improvement.
Figure 11:
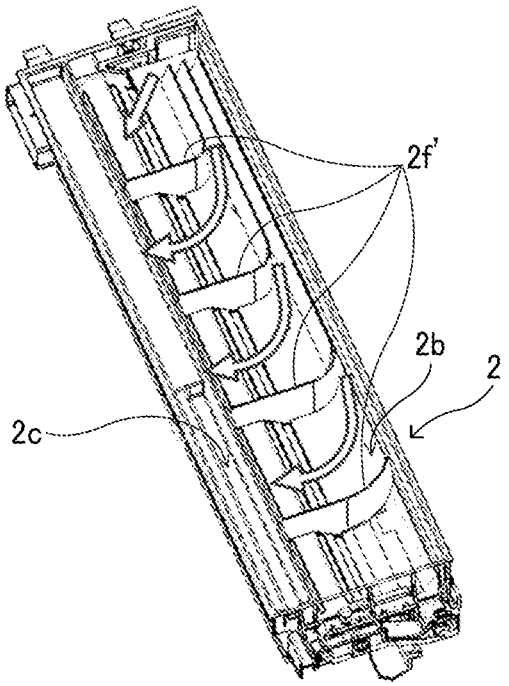
FIG. 11 is an explanatory diagram illustrating an airflow in the exhaust mechanism in FIG. 10.

FIG. 10 is a perspective view illustrating an exhaust mechanism for the charging device 2 after improvement. FIG. 11 is an explanatory diagram illustrating the airflow in the exhaust mechanism in FIG. 10.

The exhaust mechanism after improvement includes a changed partition plate 2*f'* in the first flow path 2*b* to guide the airflow sent from the intake duct 2*d* and divide into four, the closest side, the second closest side, the second farthest side, and the farthest side from the intake duct 2*d* in the axial direction of the photoconductor 1. Inlets of spaces divided by the partition plate 2*f'* are narrowed to increase speeds of airflows, and the position and height of the partition plate 2*f'* are changed to smoothly flow the airflows in the first flow path 2*b* and around the photoconductor 1.

The above-described improvement attains a smooth airflow in the axial direction of the photoconductor 1, which allows discharge products generated by the discharge in the charger 2*a* to be efficiently exhausted along the axial direction of the photoconductor 1 to the exhaust duct 2*e*. As a result, the portion at which the image deletion occurs does not spread out from the surface portion opposite the charger 2*a* in the circumferential direction of the photoconductor 1. Even the short detection toner pattern can easily and accurately detect the occurrence of the image deletion.

Optimizing the amount of lubricant applied to the photoconductor 1 is reducing the amount of lubricant applied to the photoconductor 1 because the lubricant is one of the causative substances of the image deletion. Specifically, the pressure spring 3*c* is designed to push the solid lubricant 3*b* to the application roller 3*a* with a small pressing force.

First Variation

Next, a description is given of a first variation of the refreshing operation in the present embodiment.

When the portion at which the image deletion occurs spreads in the circumferential direction of the photoconductor 1, the image deletion may cover the short detection toner pattern T. In this case, the controller 100 cannot suitably determine whether the image deletion occurs based on the fluctuation range of the toner adhesion amount in the detection toner pattern T as in the above-described refreshing operation. Therefore, in the first variation, the controller 100 adds, to the above-described refreshing operation, an operation to lengthen the detection toner pattern T based on a condition that causes the portion at which the image deletion occurs to spread in the circumferential direction of the photoconductor 1.

Figure 12:
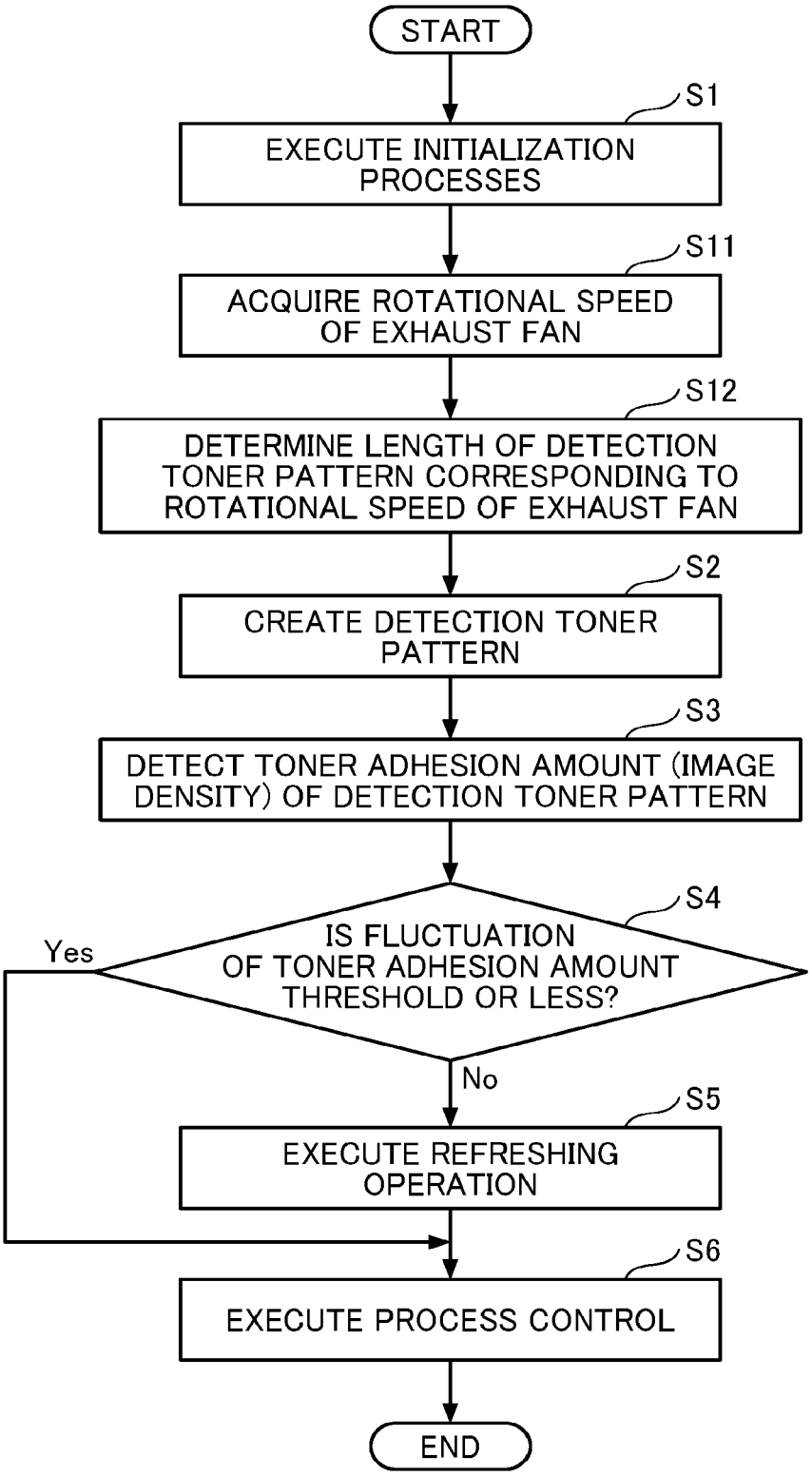
FIG. 12 is a flowchart illustrating a flow of the refreshing operation according to a first variation.

FIG. 12 is a flowchart illustrating a flow of the refreshing operation according to the first variation.

In the first variation, after completing various initialization processes in step S1, the controller 100 acquires a rotational speed of an exhaust fan 2*g* provided in the exhaust mechanism of the charging device 2 in step S11. Decrease of an ability to exhaust ambient gases around the photoconductor 1 deteriorates an ability to remove the discharge products generated by the charger 2*a* and spreads the portion at which the image deletion occurs in the circumferential direction of the photoconductor 1 out of the surface portion opposite the charger 2*a*. When the ability to exhaust ambient gases around the photoconductor 1 decreases, load of a motor for the exhaust fan 2*g* increases, and the rotational speed of the exhaust fan 2*g* decreases. The controller 100 in the first variation uses this relation to determine how the portion at which the image deletion occurs spreads in the circumferential direction of the photoconductor 1 based on the rotational speed of the exhaust fan 2*g*.

In the first variation, when the controller 100 acquires the rotational speed of the exhaust fan 2*g* in step S11, the controller 100 determines the length of the detection toner pattern T corresponding to the rotational speed in step S12 to create the detection toner pattern T having the determined length in step S2.

Table 1 below is a table illustrating an example of a correspondence relationship between the rotational speed of the exhaust fan 2*g* and the length of the detection toner pattern in the first variation.

TABLE 1

| | Rotational speed of exhaust fan | | |
|---|---|---|---|
| | 3000 rpm | 2500 rpm | 2000 rpm |
| Length of detection toner pattern | 80 mm | 160 mm | 240 mm |

In the first variation, when the rotational speed of the exhaust fan 2*g* is equal to or less than 2500 rpm, the ability to exhaust ambient gases deteriorates, and the portion at which the image deletion occurs in the circumferential direction of the photoconductor 1 begins to spread larger than 43 mm that is the length of the surface portion opposite the charger 2*a*, that is, a length of the charger 2*a* in the circumferential direction of the photoconductor 1. As a result, the detection toner pattern having a length of 80 mm may not include both the portion on which the image deletion occurs and the portion on which the image deletion does not occur. Therefore, when the rotational speed of the exhaust fan 2*g* is 2500 rpm or less, the controller 100 forms the detection toner pattern longer than 80 mm according to the rotational speed.

The following processes of the refreshing operation are equivalent to those of the embodiments as described above, and thus their description is omitted.

According to the first variation, even when the decrease of an ability to exhaust ambient gases around the photoconductor 1 deteriorates the ability to remove the discharge products generated by the charger 2*a* and accuracy of the detection that determines whether the image deletion occurs using the short detection toner pattern, the controller 100 lengthens the detection toner pattern and can maintain the accuracy of the detection that determines whether the image deletion occurs.

Second Variation

Next, a description is given of a second variation of the refreshing operation in the present embodiment.

In the second variation, similar to the first variation described above, the controller 100 adds the operation to lengthen the detection toner pattern T based on the condition that causes the portion at which the image deletion occurs to spread in the circumferential direction of the photoconductor 1 to the above-described refreshing operation.

Figure 13:
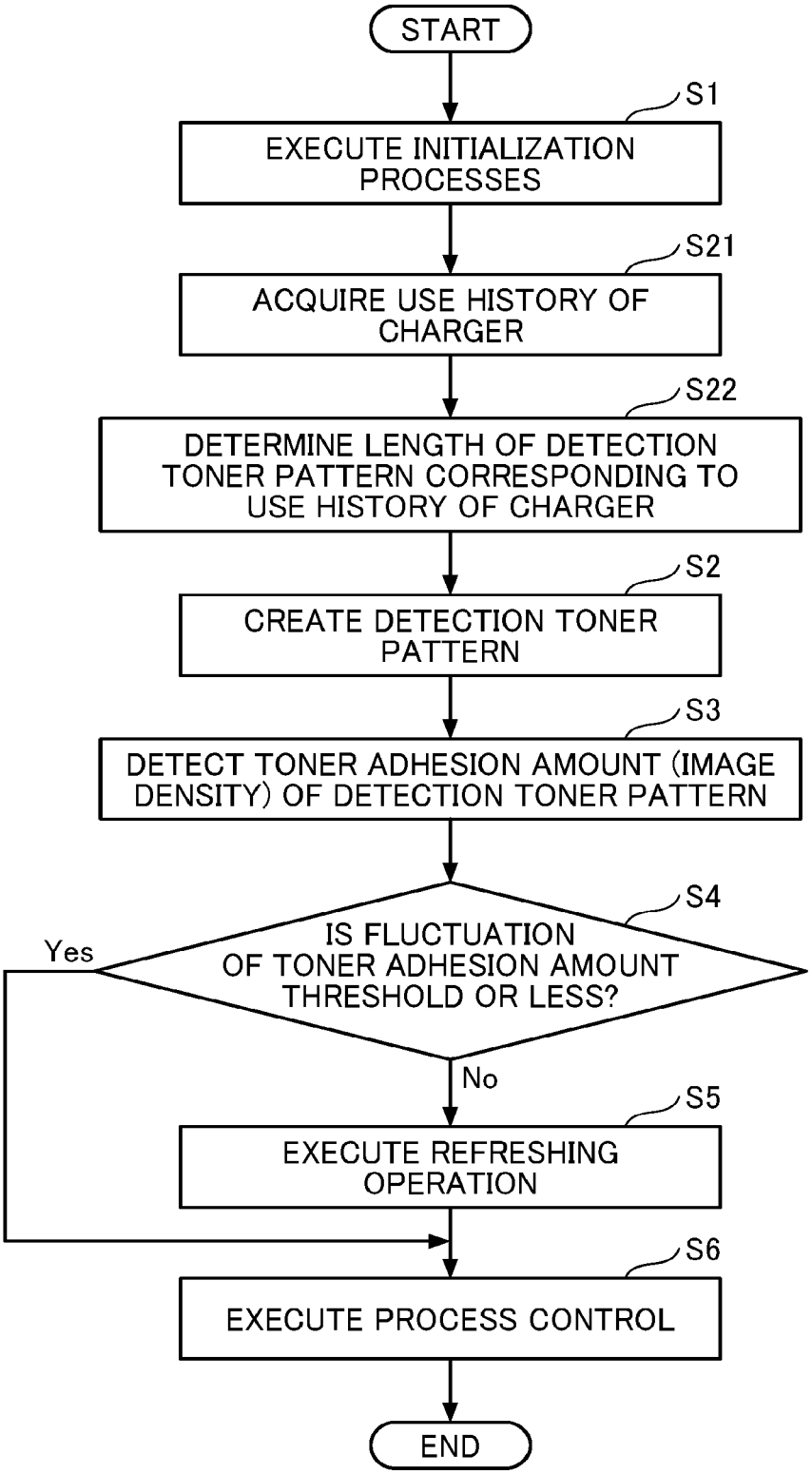
FIG. 13 is a flowchart illustrating a flow of the refreshing operation according to a second variation.

FIG. 13 is a flowchart illustrating a flow of the refreshing operation according to the second variation.

In the second variation, after completing various initialization processes in step S1, the controller 100 acquires a use history of the charger 2*a* in the charging device 2 in step S21. Using the charger 2*a* deteriorates a discharge wire and grid wires in the charger 2*a*, which increases an amount of the discharge products that is one of the causative substances of the image deletion. Increase of the amount of the discharge products spreads the portion at which the image deletion occurs in the circumferential direction of the photoconductor 1 out of the surface portion opposite the charger 2*a*. The controller 100 in the second variation determines how the charger 2*a* deteriorates based on the use history of the charger 2*a* and how the portion at which the image deletion occurs spreads in the circumferential direction of the photoconductor 1 based on the use of the history of the charger 2*a*. As the use history of the charger 2*a*, for example, the controller 100 may use a number of printed sheets from start of use of the charger 2*a* that is obtained by using a counter that counts the number of the printed sheets and is disposed in the printer according to the present embodiment.

In the second variation, when the controller 100 acquires the use history of the charger 2*a* in step S21, the controller 100 determines the length of the detection toner pattern T corresponding to the use history in step S22 to create the detection toner pattern T having the determined length in step S2.

Table 2 below is a table illustrating an example of a correspondence relationship between the use history of the charger 2*a* that is the number of printed sheets and the length of the detection toner pattern in the second variation.

TABLE 2

| | Use history of charger (Number of printed sheets) | | |
|---|---|---|---|
| | 0 to 600k | 601k to 900k | 901k to 1500k |
| Length of detection toner pattern | 80 mm | 160 mm | 240 mm |

In the second variation, when the use history of the charger 2*a* exceeds 600,000 printed sheets, the portion at which the image deletion occurs in the circumferential direction of the photoconductor 1 begins to spread larger than 43 mm that is the length of the surface portion opposite the charger 2*a*, that is, a length of the charger 2*a* in the circumferential direction of the photoconductor 1. As a result, the detection toner pattern having a length of 80 mm may not include both the portion on which the image deletion occurs and the portion on which the image deletion does not occur. Therefore, when the use history of the charger 2*a* exceeds 600,000 printed sheets, the controller 100 forms the detection toner pattern longer than 80 mm according to the number of printed sheets.

The following processes of the refreshing operation are equivalent to those of the embodiments as described above, and thus their description is omitted.

According to the second variation, even when the deterioration of the charger 2*a* increases the discharge products generated by the charger 2*a* and deteriorates accuracy of the detection that determines whether the image deletion occurs using the short detection toner pattern, the controller 100 lengthens the detection toner pattern and can maintain the accuracy of the detection that determines whether the image deletion occurs.

Third Variation

Next, a description is given of a third variation of the refreshing operation in the present embodiment.

Using the photoconductor 1 causes deterioration of the photoconductor 1 over time, and an initial exposure light amount of the exposure device 9 becomes not enough to get a target exposed area potential and causes an increase of an absolute value of the exposed area potential (VL), which results in decrease of the toner adhesion amount and decrease of the image density. The decrease of the toner adhesion amount causes decrease of a difference in toner adhesion amount between the portion on which the image deletion occurs and the portion on which the image deletion does not occur on the detection toner pattern, which deteriorates the accuracy of the detection that determines whether the image deletion occurs. Therefore, in the third variation, the controller 100 adds an operation to increase the toner adhesion amount of the detection toner pattern T based on the deterioration of the photoconductor 1.

Figure 14:
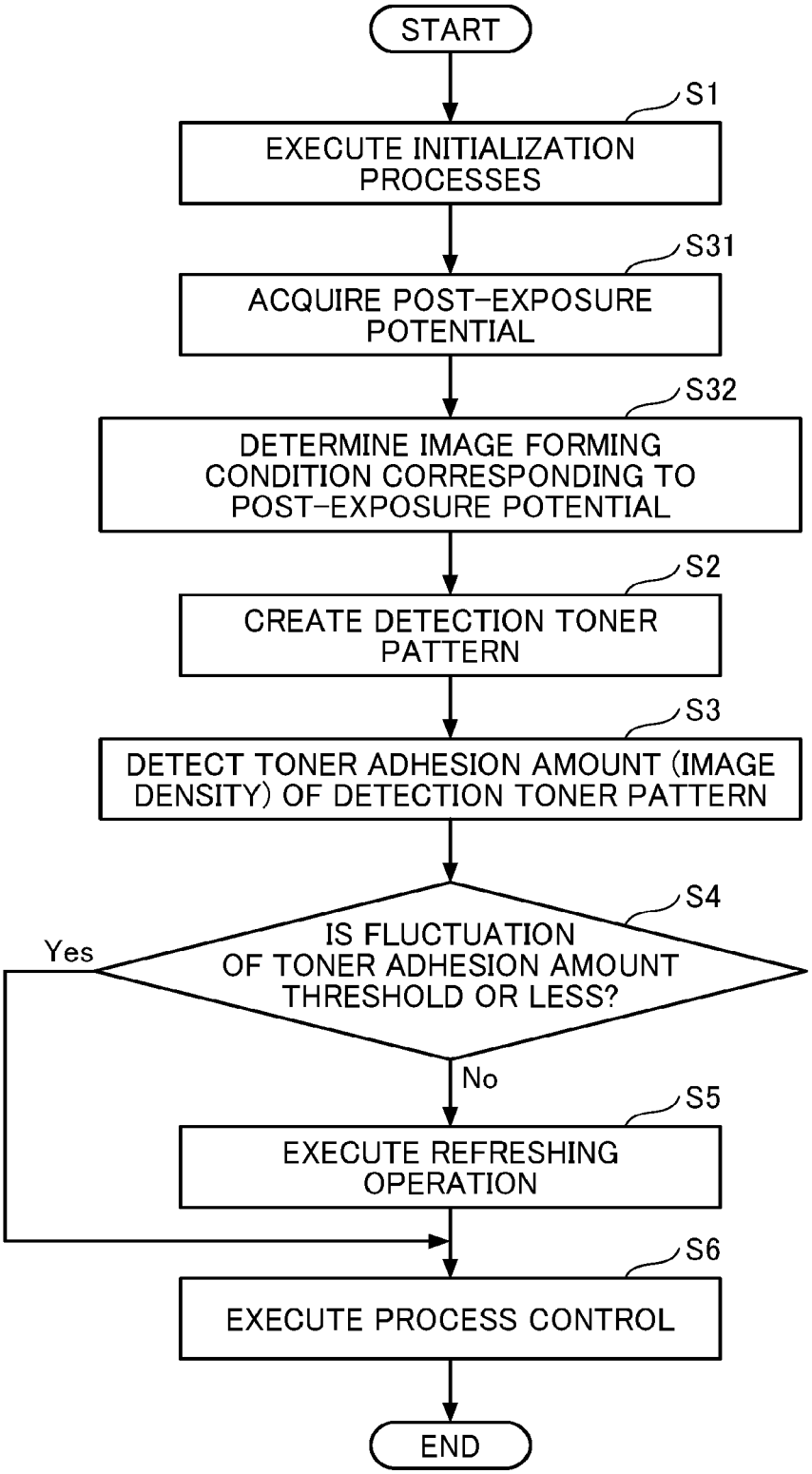
FIG. 14 is a flowchart illustrating a flow of the refreshing operation according to a third variation.

FIG. 14 is a flowchart illustrating a flow of the refreshing operation according to the third variation.

In the third variation, after completing various initialization processes in step S1, similar to the typical image forming operation, the controller 100 controls the charging device 2 to uniformly charge the surface of the photoconductor 1 and controls the exposure device 9 to form an electrostatic latent image of a pattern for potential detection on the charged surface of the photoconductor 1. Subsequently, the controller 100 controls the potential sensor 6 to detect the exposed area potential of the pattern for the potential detection and acquires the exposed area potential of the pattern in step S31 In step S32, the controller 100 determines the image forming condition corresponding to the exposed area potential to create the detection toner pattern T based on the determined image forming condition in step S2.

Table 3 below is a table illustrating an example of a correspondence relationship between the deterioration of the photoconductor 1 that is the exposed area potential and the image forming condition in the third variation.

TABLE 3

| | Deterioration of photoconductor (exposed area potential) | | |
|---|---|---|---|
| | To 50 (−V) | 51 to 59 (−V) | From 60 (−V) |
| Writing LD power (%) | 100 | 120 | 180 |
| Developing bias (−V) | 450 | 500 | 550 |
| Image density set for detection toner pattern (%) | 20 | 40 | 60 |

In the third variation, when the absolute value of the exposed area potential indicating the deterioration state of the photoconductor 1 exceeds 50 [−V], the controller 100 determines that the deterioration of the photoconductor 1 occurs and causes the decrease in the toner adhesion amount and the image density and changes the image forming condition according to the deterioration level of the photoconductor 1 to avoid the decrease in the toner adhesion amount. The image forming conditions to be changed include, for example, the exposure intensity (writing LD power) in the exposure device 9. In this case, as illustrated in Table 3, the controller 100 sets the exposure intensity corresponding to the deterioration level of the photoconductor 1 that is the exposed area potential to avoid the decrease of the toner adhesion amount. Alternatively, the image forming condition to be changed may be, for example, the developing bias. In this case, as illustrated in Table 3, the controller 100 sets the absolute value of the developing bias corresponding to the deterioration level of the photoconductor 1 that is the exposed area potential to avoid the decrease of the toner adhesion amount. The image forming condition to be changed may be, for example, the image density set for the detection toner pattern that is the toner adhesion amount set for the detection toner pattern. In this case, as illustrated in Table 3, the controller 100 sets the image density set for the detection toner pattern that is the toner adhesion amount set for the detection toner pattern corresponding to the deterioration level of the photoconductor 1 that is the exposed area potential to avoid the decrease of the toner adhesion amount.

The following processes of the refreshing operation are equivalent to those of the embodiments as described above, and thus their description is omitted.

In the third variation, even when the deterioration of the photoconductor 1 occurs and causes the decrease in the toner adhesion amount and the image density, the controller 100 can maintain the accuracy of the detection that determines whether the image deletion occurs because the controller 100 adjusts the image forming condition to avoid the decrease in the toner adhesion amount, that is, the image density, in the detection toner pattern.

The configurations according to the above-descried embodiment and variations are not limited thereto and can achieve the following aspects effectively.

First Aspect

In the first aspect, the image forming apparatus such as the printer includes the latent image bearer such as the photoconductor 1, the charger such as the charger 2*a* to charge the surface of the latent image bearer, the exposure device such as the exposure device 9 to expose the surface of the latent image bearer to form the electrostatic latent image of the detection toner pattern T on the latent image bearer, the developing device such as the developing device 4 to develop the electrostatic latent image of the detection toner pattern T on the surface of the latent image bearer to form the detection toner pattern T, the toner adhesion amount detector such as the image density sensor 7 to detect a toner adhesion amount of the detection toner pattern formed on the latent image bearer, and control circuitry such as the controller 100 to control the charger, the exposure device, the developing device, and the toner adhesion amount detector. The control circuitry such as the controller 100 in the first aspect controls the charger, the exposure device, and the developing device to form the detection toner pattern T shorter than the circumferential length of the latent image bearer in the circumferential direction of the latent image bearer at the area of the latent image bearer including at least a part of the portion P1 of the latent image bearer opposite the charger when the latent image bearer stops rotation, controls the toner adhesion amount detector to detect the toner adhesion amount of the detection toner pattern, and executes the refreshing operation to recover the surface of the latent image bearer from the deteriorated state due to the discharge product based on the result of the detection toner pattern T detected by the toner adhesion amount detector.

Generally, the discharge in the charger generates the discharge product, and the discharge product adheres to the surface of the latent image bearer for a certain period of time when the latent image bearer stops its rotation and causes the image deletion on the surface of the latent image bearer to which the discharge product adheres depending on the temperature and humidity. In the image forming apparatus including the lubricant applicator to apply the lubricant onto the surface of the latent image bearer, the discharge product is bound to the lubricant on the surface of the latent image bearer and is more likely to occur the image deletion.

The controller 100 determines whether the image deletion occurs, that is, whether the refreshing operation is necessary by forming the detection toner pattern on the surface of the latent image bearer at a predetermined refreshing operation timing such as a recovery timing after the certain period of time when the latent image bearer stops its rotation and detecting the toner adhesion amount of the detection toner pattern. However, forming the detection toner pattern at every predetermined refreshing operation timing needs consumption of toner that is not used for image formation, causing a decrease in toner yield.

The present inventor found that the image deletion remarkably occurs at the surface portion of the latent image bearer opposite the charger when the latent image bearer stops the rotation. Conceivably, this is because the charger generates the discharge products that causes the image deletion, and most of the discharge products adheres to the surface portion of the latent image bearer opposite the charger.

Therefore, the control circuitry in the first aspect controls the charger, the exposure device, and the developing device to form the detection toner pattern shorter than the circumferential length of the latent image bearer in the circumferential direction of the latent image bearer at the area of the latent image bearer including at least a part of the portion of the latent image bearer opposite the charger when the latent image bearer stops the rotation. The detection toner pattern T in the first aspect prevents the toner yield from decreasing because the detection toner pattern T is shorter than the detection toner pattern longer than or equal to the circumferential length of the latent image bearer. Moreover, according to the first aspect, since the detection toner pattern is formed on the surface portion of the latent image bearer at which the image deletion remarkably occurs, the control circuitry can determine whether the image deletion occurs with the same degree of accuracy as in the case in which the controller uses the detection toner pattern longer than or equal to the circumferential length of the latent image bearer.

Second Aspect

In the second aspect, the control circuitry such as the controller 100 in the image forming apparatus according to the first aspect controls the charger, the exposure device, and the developing device to form the detection toner pattern additionally at a part of a portion of the latent image bearer not opposite the charger when the latent image bearer stops the rotation, such as the surface portions not opposite the charger P2 and P3, controls the toner adhesion amount detector to detect the toner adhesion amount of the detection toner pattern corresponding to the part of the portion of the latent image bearer not opposite the charger, and executes the refreshing operation based on a result obtained by comparing the result of the detection toner pattern corresponding to the portion of the latent image bearer opposite the charger and a result of the detection toner pattern corresponding to the portion of the latent image bearer not opposite the charger, detected by the toner adhesion amount detector.

Even when the detection toner pattern T is formed at only the surface portion opposite the charger of the latent image bearer stopping the rotation, if the appropriate threshold is set that can distinguish the toner adhesion amount detection results of the detection toner pattern T at one portion at which the image deletion occurs and at the other portion, the control circuitry can determine whether the image deletion occurs based on the comparison between the threshold and the toner adhesion amount detection results of the detection toner pattern T. However, since the toner adhesion amount detection result of the detection toner pattern T is affected by not only the image deletion but also changes in image forming conditions, environmental changes, and the like, it may be difficult to determine whether the image deletion occurs with high accuracy.

The detection toner pattern T in the second aspect includes the portion including at least the part of the surface portion opposite the charger of the latent image bearer stopping the rotations in the circumferential direction of the latent image bearer and the portion including at least a part of the surface portion other than the surface portion opposite the charger, that is, the surface portion not opposite the charger in the circumferential direction of the latent image bearer. Creating such the detection toner pattern T enables the control circuitry to determine whether the image deletion occurs based on the comparison of the detection result (toner adhesion amount) of the detection toner pattern T corresponding to the surface portion opposite the charger of the latent image bearer stopping rotations and the detection result (toner adhesion amount) of the detection toner pattern T corresponding to the surface portion not opposite the charger of the latent image bearer stopping rotations, both of which are detected by the image density sensor 7. That is, when the image deletion occurs, the controller 100 can check the relative difference in the toner adhesion amount between the surface portion not opposite the charger at which the image deletion does not occur and the surface portion opposite the charger at which the image deletion does occur. Therefore, the controller 100 can remove the influence of changes in image forming conditions and environmental fluctuations and determine whether the image deletion occurs more accurately.

Third Aspect

In the third aspect, the image forming apparatus according to the second aspect includes the exhaust mechanism such as the exhaust mechanism including the exhaust fan 2*g* to exhaust the gas surrounding the latent image bearer, and the control circuitry controls the charger, the exposure device, and the developing device to lengthen the detection toner pattern in accordance with the decrease in the exhaust capability of the exhaust mechanism.

The decrease in the exhaust capability to exhaust the gas surrounding the latent image bearer deteriorates the ability to remove the discharge products generated by the charger and spreads the portion at which the image deletion occurs in the circumferential direction of the latent image bearer out of the surface portion opposite the charger. When the portion at which the image deletion occurs spreads in the circumferential direction of the latent image bearer, the image deletion may cover the entire short detection toner pattern. In this case, the control circuitry cannot check the relative difference in the toner adhesion amount between the surface portion not opposite the charger at which the image deletion does not occur and the surface portion opposite the charger at which the image deletion does occur and may not be able to determine whether the image deletion occurs.

In the third aspect, to lengthen the detection toner pattern in accordance with the decrease in the exhaust capability of the exhaust mechanism avoids such situation.

Fourth Aspect

In the fourth aspect, the control circuitry such as the controller 100 in the image forming apparatus according to the second aspect controls the charger, the exposure device, and the developing device to lengthen the detection toner pattern in accordance with a decrease in a capability of the charger.

The decrease in the capability of the charger increases the amount of the discharge product generated by the charger and spreads the portion at which the image deletion occurs in the circumferential direction of the latent image bearer out of the surface portion opposite the charger. When the portion at which the image deletion occurs spreads in the circumferential direction of the latent image bearer, the image deletion may cover the entire short detection toner pattern. In this case, the control circuitry cannot check the relative difference in the toner adhesion amount between the surface portion not opposite the charger at which the image deletion does not occur and the surface portion opposite the charger at which the image deletion does occur and may not be able to determine whether the image deletion occurs.

In the fourth aspect, to lengthen the detection toner pattern in accordance with the decrease in a capability of the charger avoids such situation.

Fifth Aspect

In the fifth aspect, the control circuitry such as the controller 100 in the image forming apparatus according to the second aspect controls at least one of the charger, the exposure device, and the developing device to increase the toner adhesion amount of the detection toner pattern in accordance with the deterioration of the latent image bearer.

The deterioration of the latent image bearer totally decreases the toner adhesion amount of the detection toner pattern, which causes the decrease of the difference in toner adhesion amount between the surface portion not opposite the charger that is the portion on which the image deletion does not occur and the surface portion opposite the charger that is the portion on which the image deletion occurs. In this case, determining whether the image deletion occurs based on the difference described above becomes difficult.

In the fifth aspect, increasing the toner adhesion amount of the detection toner pattern in accordance with the deterioration of the latent image bearer enables the control circuitry to acquire the same difference in the toner adhesion amount between the surface portion not opposite the charger that is the portion on which the image deletion does not occur and the surface portion opposite the charger that is the portion on which the image deletion occurs as the one before the deterioration of the latent image bearer.

Sixth Aspect

In the sixth aspect, the control circuitry such as the controller 100 in the image forming apparatus according to the fifth aspect controls the exposure device such as the exposure device 9 to change the exposure intensity such as the writing LD power to increase the toner adhesion amount of the detection toner pattern.

According to this, the toner adhesion amount of the detection toner pattern can be increased with relatively easy control.

Seventh Aspect

In the seventh aspect, the control circuitry such as the controller 100 controls the developing device such as the developing device 4 to change the developing bias to increase the toner adhesion amount of the detection toner pattern.

According to this, the toner adhesion amount of the detection toner pattern can be increased with relatively easy control.

The present disclosure is not limited to the above-described embodiments, and the configuration of the present embodiment can be appropriately modified other than suggested in each of the above embodiments within a scope of the technological concept of the present disclosure. Also, the positions, the shapes, and the number of components are not limited to the embodiments, and they may be modified suitably in implementing the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above.

Each of the functions of the described embodiments may be implemented by one or more processing circuits or control circuitry. Processing circuits includes a programmed processor, as a processor includes control circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a latent image bearer;

a charger configured to charge a surface of the latent image bearer;

an exposure device configured to expose the surface of the latent image bearer to form an electrostatic latent image of a detection toner pattern on the latent image bearer;

a developing device configured to develop the electrostatic latent image of the detection toner pattern on the surface of the latent image bearer to form the detection toner pattern;

a toner adhesion amount detector configured to detect a toner adhesion amount of the detection toner pattern formed on the latent image bearer; and control circuitry configured to:

control the charger, the exposure device, and the developing device to form the detection toner pattern shorter than a circumferential length of the latent image bearer in a circumferential direction of the latent image bearer at an area of the latent image bearer including at least a part of an opposite portion of the latent image bearer opposite the charger when the latent image bearer stops rotation;

control the toner adhesion amount detector to detect the toner adhesion amount of the detection toner pattern; and execute a refreshing operation to recover the surface of the latent image bearer from a deteriorated state due to a discharge product based on a result of the detection toner pattern detected by the toner adhesion amount detector.

2. The image forming apparatus according to claim 1, wherein the control circuitry:

controls the charger, the exposure device, and the developing device to form the detection toner pattern additionally at a part of a non-opposite portion of the latent image bearer not opposite the charger when the latent image bearer stops the rotation;

controls the toner adhesion amount detector to detect the toner adhesion amount of the detection toner pattern corresponding to the part of the non-opposite portion of the latent image bearer; and executes the refreshing operation based on a result obtained by comparing the result of the detection toner pattern corresponding to the opposite portion of the latent image bearer and a result of the detection toner pattern corresponding to the non-opposite portion of the latent image bearer, detected by the toner adhesion amount detector.

3. The image forming apparatus according to claim 2, further comprising an exhaust mechanism configured to exhaust a gas surrounding the latent image bearer, wherein the control circuitry controls the charger, the exposure device, and the developing device to lengthen the detection toner pattern in accordance with a decrease in an exhaust capability of the exhaust mechanism.

4. The image forming apparatus according to claim 2, wherein the control circuitry controls the charger, the exposure device, and the developing device to lengthen the detection toner pattern in accordance with a decrease in a capability of the charger.

5. The image forming apparatus according to claim 2, wherein the control circuitry controls at least one of the charger, the exposure device, and the developing device to increase the toner adhesion amount of the detection toner pattern in accordance with a deterioration of the latent image bearer.

6. The image forming apparatus according to claim 5, wherein the control circuitry controls the exposure device to change an exposure intensity to increase the toner adhesion amount of the detection toner pattern.

7. The image forming apparatus according to claim 5, wherein the control circuitry controls the developing device to change a developing bias to increase the toner adhesion amount of the detection toner pattern.

* * * * *